US006062988A

United States Patent [19]

Yamamoto

[11] Patent Number: 6,062,988

[45] Date of Patent: May 16, 2000

[54] METALLIC HOLLOW GOLF CLUB HEAD AND MANUFACTURING METHOD OF THE SAME

[75] Inventor: Shinji Yamamoto, Hiratsuka, Japan

[73] Assignee: The Yokohama Rubber Co., Ltd., Tokyo, Japan

[21] Appl. No.: 08/933,009

[22] Filed: Sep. 18, 1997

[30] Foreign Application Priority Data

Oct. 2, 1996 [JP] Japan ..... 8-261962

[51] Int. Cl.[7] ..... A63B 53/04

[52] U.S. Cl. ..... 473/324; 473/338; 473/345; 473/409

[58] Field of Search ..... 473/324, 334, 473/335, 336, 337, 338, 339, 345, 346, 349, 409

[56] References Cited

U.S. PATENT DOCUMENTS 4,313,607 2/1982 Thompson .
4,795,159 1/1989 Nagamoto .
5,154,424 10/1992 Lo .
5,193,811 3/1993 Okumoto .
5,351,958 10/1994 Helmstetter .
5,421,577 6/1995 Kobayashi .
5,755,624 5/1998 Helmstetter .

*Primary Examiner*—Sebastiano Passaniti
*Attorney, Agent, or Firm*—Finnegan, Henderson, Farabow, Garrett & Dunner, L.L.P.

[57] ABSTRACT

A metallic hollow golf club head and a method for manufacturing it in which a head structure is constructed by welding a light metal sole plate, in which a heavy metal weight has been secured to an inner surface thereof, to a light metal outer mold comprising a hosel and then injecting thermosetting resin into the hollow portion of the head structure so as to cover at least the inner surface of the sole plate and to flow into any gap between the sole plate and the weight and the joint between the sole plate and the outer mold.

9 Claims, 2 Drawing Sheets

METALLIC HOLLOW GOLF CLUB HEAD AND MANUFACTURING METHOD OF THE SAME

BACKGROUND OF THE INVENTION

The present invention relates to a metallic hollow golf club head and a manufacturing method of the same, and more particularly to a metallic hollow golf club head in which a weight formed from a different type of metal to a sole plate can be reliably secured to the inner surface of said sole plate so as not to create a gap and to a manufacturing method of the same.

A golf club head consisting of titanium or titanium alloy has recently been attracting attention. In this type of light metal golf club head, a heavy metal weight is secured to the inner surface of a sole plate on the club head in order to lower the center of gravity of the club head body, increase the moment of inertia and perform other adjustments to the position of the center of gravity. Conventionally, this heavy metal weight has been solidly secured to the sole plate using a bolt, a rivet, welding or such like.

However, when a light metal sole plate and a heavy metal weight are welded together, if the weight consists of a heavy metal having a specific gravity greater than 10 such as tungsten, tantalum, gold or platinum, it has been difficult to obtain sufficient welding strength, especially when the sole plate consists of titanium or a titanium alloy.

Alternatively, when a weight is secured to the sole plate using a bolt or a rivet or such like, since a sole plate is generally constructed in a slightly curved shape, it is difficult to secure the inner surface of the sole plate to the weight in absolute contact with one another, with the result that minute gaps are created. Such minute gaps between the weight and the inner surface of the sole plate can result in unpleasant sound being produced when the golf club is swung or strikes a ball or makes strong contact with the ground.

SUMMARY OF THE INVENTION

It is therefore the object of the present invention to provide a metallic hollow golf club head in which a weight formed from heavy metal can be reliably secured to a sole plate formed from light metal while enabling gaps between the sole plate and the weight to be reliably filled in thereby preventing the generation of allophones and a manufacturing method of the same.

In order to achieve the above objectives, a metallic hollow golf club head of the present invention is characterized in that a head structure is constructed by welding a light metal sole plate wherein a heavy metal weight has been secured to the inner surface of said sole plate to a light metal outer mold comprising a hosel; and thermosetting resin is injected into the hollow portion of the head structure so as to cover at least the inner surface of the sole plate and to fill the gap between the sole plate and the weight and the join between the sole plate and the outer mold.

Furthermore, in order to achieve the above objectives, a metallic hollow golf club head manufacturing method of the present invention is characterized in that an outer mold comprising a hosel on the upper portion and an opening on the lower portion and a sole plate in which a heavy metal weight has been secured to the inner surface of said sole plate are constructed using light metals; the sole plate is welded to the opening of the outer mold thereby forming a head structure; liquefied thermosetting resin is poured into the hollow portion of the head structure through an opening in the hosel; the head structure is heated and pressure within the hollow portion is reduced to lower the viscosity of the thermosetting resin, thereby causing the thermosetting resin to cover at least the inner surface of the sole plate and to fill the gap between the sole plate and the weight and the join between the sole plate and the outer mold; thereafter, pressure-reduction is terminated and heating of the head structure continues until the thermosetting resin has been cured.

The weight can be secured to the sole plate by providing a countersunk portion on the inner surface of the sole plate, fitting the weight into the countersunk portion, creating a through hole through the weight and the sole plate, inserting a rivet into this through hole and caulking the rivet.

Furthermore, while the head structure is formed from titanium or titanium alloy, the resin may preferably comprise fairly strong and flexible thermosetting resin such as rubber modified epoxy resin or urethane modified acrylic resin or such like in order to prevent fractures in the resin after being cured as a result of vibration caused when the golf club is swung or strikes the ball.

Furthermore, to ensure that sufficient resin flows into the gap between the sole plate and the weight and into the join between the sole plate and the head outer mold, the viscosity of the resin may preferably be 2000 cps or less, more preferably 500 cps or less in a state of temperature at which the resin has a lowest viscosity during the curing process.

According to the present invention, by injecting liquefied thermosetting resin into the hollow portion of the head structure while heating the golf club head and lowering the pressure inside the hollow portion, the viscosity of the resin is lowered so as to flow sufficient resin into the gap between the sole plate and the weight and into the join between the sole plate and the outer mold, and moreover to cover bits of metal and such like which have fallen onto the inner surface of the sole plate. Thereafter, pressure reduction is terminated, and by continuing to heat the head structure until the resin is cured, the weight can be reliably secured to the sole plate and gaps between the weight and the sole plate can be filled, thereby preventing generation of unpleasant sounds.

For a more complete understanding of the present invention and the advantages thereof, reference is now made to the following description taken in conjunction with the accompanying drawings.

DETAILED DESCRIPTION OF THE PREFERRED EMBODIMENTS

In a metallic hollow golf club head manufacturing method of the present invention, a sole plate 5 and an outer mold 4 fitted with a hosel portion 3 are first molded from light metal such as titanium or titanium alloy. Furthermore, a weight W comprising heavy metal is secured beforehand on the inner surface 5*a* of the sole plate 5. A metal or alloy having specific gravity of not less than 10 such as tungsten, tantalum, gold, platinum or such like can be used as the heavy metal to form this weight W.

Figure 1:
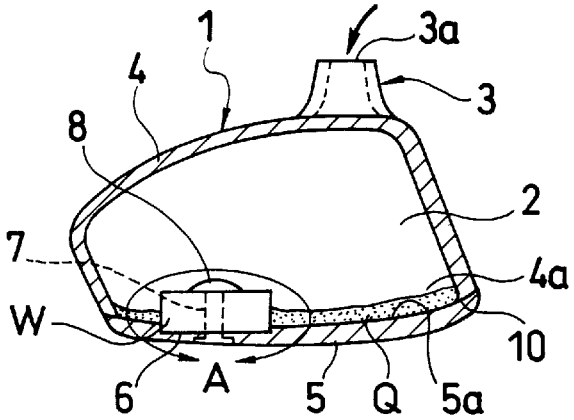
FIG. 1 is a cross-sectional diagram depicting liquefied resin injected into the hollow portion of a head structure in a metallic hollow golf club head manufacturing method according to an embodiment of the present invention.
Figure 2:
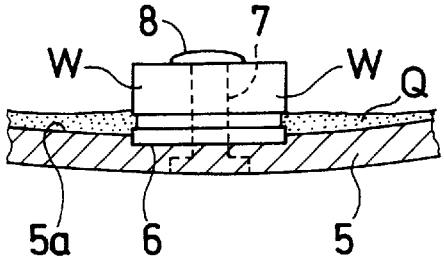
FIG. 2 is a diagram depicting an enlarged side view of part A of FIG. 1.

The weight W is secured to the sole plate 5 by the following method. First, a countersunk portion 6 having a cross-sectional shape corresponding to the shape of the lower portion of the weight W is created beforehand on the inner surface 5*a* of the sole plate 5 as shown in FIG. 2 and the weight W is press-fitted into this countersunk portion 6. Next, a through hole 7 is created through the middle of the weight W and the sole plate 5, a rivet 8 is inserted into the through hole 7 and the weight W is secured to the inner surface 5*a* of the sole plate 5 by calking or pressing the tip of the rivet 8

The cross-sectional shape of the countersunk portion 6 is a circular depression when the lower portion of the weight W is cylindrical and a triangular depression when the lower portion of the weight W is triangular; in other words, the cross-sectional shape of the countersunk portion 6 should be the same shape as the lower portion of the weight W. Furthermore, the through hole 7 provided in the weight W and the sole plate 5 can be formed therein before fitting the weight W into the countersunk portion 6.

Next, the sole plate 5 to which the weight W has been secured is matched to an opening 4*a* on the lower side of the outer mold 4 and solidly welded thereto so as to produce a head structure 1. Next, liquefied thermosetting resin Q is injected into the hollow portion of the head structure 1 through an opening 3*a* in the hosel 3. The thermosetting resin Q can be injected using a nozzle shaped instrument. The amount of resin Q injected can be set to an amount appropriate to the size of the head structure 1, the number of weights W and such like.

Figure 3:
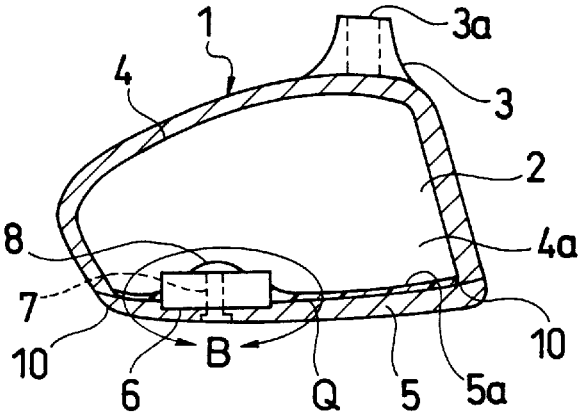
FIG. 3 is a diagram depicting a state in which resin injected into the hollow portion of a head structure has been cured in a metallic hollow golf club head manufacturing method according to an embodiment of the present invention.
Figure 4:
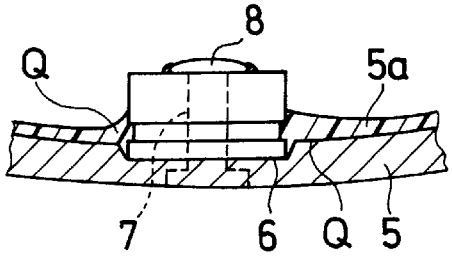
FIG. 4 is a diagram depicting an enlarged side view of part B of FIG. 3.

After injecting the resin Q in the way described above, the head structure 1 is heated and pressure inside the hollow portion 2 is reduced, thereby reducing the viscosity of the resin Q and causing the resin Q to cover at least the inner surface 5*a* of the sole plate 5 as FIGS. 3 and 4 show. Moreover, the resin Q is also flowed into the join 10 between the sole plate 5 and the outer mold 4 and the gap between the sole plate 5 and the weight W.

Figure 5:
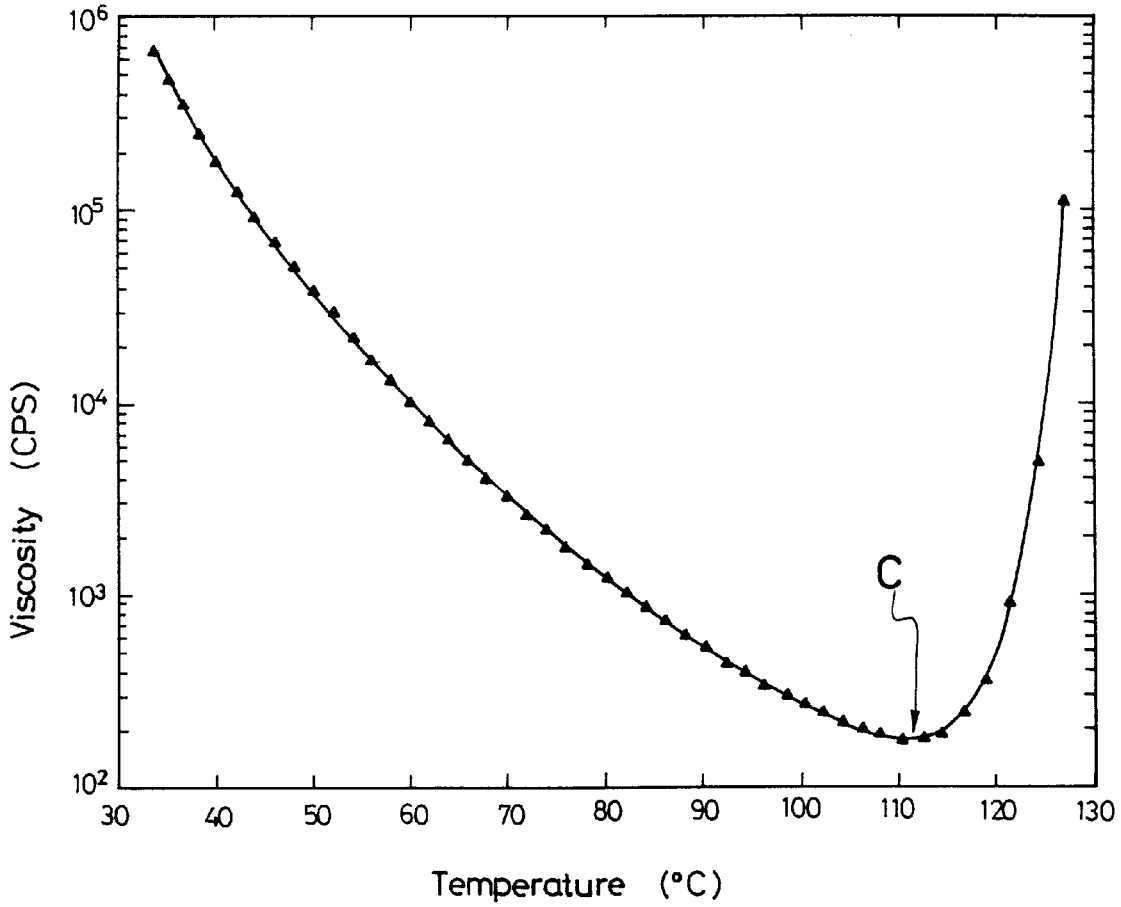
FIG. 5 is a graph showing a cure curve (temperature-viscosity) of thermosetting resin used in the present invention.

In other words, reducing pressure inside the hollow portion 2 at the same time as heating the head structure 1 lowers the viscosity of the liquefied thermosetting resin Q as shown in FIG. 5, thereby enabling the resin Q to enter narrow gaps. Pressure is reduced until the point shown at C in FIG. 5 and the pressure reducing operation terminates at the point where the viscosity of the resin Q begins to increase. The resin Q can be cured by continuing to further heat the head structure 1 after terminating pressure reduction, and the resin layers formed by the resin Q solidly affix the weight W to the sole plate 5.

In the present invention, when affixing a weight W to the sole plate 5, the entry of the resin Q can be facilitated by providing a notch around the rim of the weight W as shown in FIGS. 2 and 4; this enables the resin layers to be affixed reliably which greatly improves prevention of flaking when the golf club is swung.

As explained above, by injecting thermosetting resin Q into the hollow portion 2 of the head structure 1, flowing sufficient resin Q into the gap between the sole plate 5 and the weight W and into the join 10 between the sole plate 5 and the outer mold 4 and covering bits of metal and such like which have fallen onto the inner surface 5*a* of the sole plate 5, the weight W can be reliably secured to the sole plate 5 and gaps between the weight W and the sole plate 5 can be filled thereby preventing unpleasant sounds from being produced, even in a case in which the sole plate 5 and the weight W are formed from different types of metal.

While there have been described what are at present considered to be preferred embodiments of the invention, it will be understood that various modifications may be made thereto, and it is intended that the appended claims cover all such modifications as fall within the true spirit and scope of the invention.

What is claimed is:

1. A metallic hollow golf club head comprising a head structure having a hollow portion and constructed of a light metal sole plate, in which a heavy metal weight has been secured to an inner surface of said sole plate, welded to a light metal outer mold having a hosel and thermosetting resin injected into the hollow portion of said head structure so as to cover at least the inner surface of said sole plate and to fill any gap between said sole plate and said weight and a joint between said sole plate and said outer mold.

2. The metallic hollow golf club head of claim 1, wherein a countersunk portion is provided on the inner surface of said sole plate and said weight is fitted into said countersunk portion; a through hole is provided that passes through both said weight and said sole plate; and said weight is secured to said sole plate by a rivet inserted into said through hole and then caulked.

3. The metallic hollow golf club head of claim 1, wherein said light metal is a metal selected from the group consisting of titanium and titanium alloy.

4. The metallic hollow golf club head of claim 1, wherein said thermosetting resin is a resin selected from the group consisting of rubber degenerate epoxy resin and urethane degenerate acrylic resin.

5. A method for manufacturing a metallic hollow golf club head from an outer mold of a light metal having a hosel on an upper portion thereof and an opening on a lower portion thereof and a sole plate of a light metal in which a heavy metal weight has been secured to an inner surface thereof, said method comprising:

welding said sole plate across the opening of said outer mold to form a joint and thereby a head structure having a hollow portion;

pouring liquified thermosetting resin into the hollow portion of said head structure through an opening in said hosel;

heating said head structure and reducing the pressure within the hollow portion to thereby lower the viscosity of said thermosetting resin and cause said thermosetting resin to cover at least the inner surface of said sole plate and to fill any gap between said sole plate and said weight and the joint between said sole plate and said outer mold; and thereafter, terminating reduction of the pressure and continuing to heat said head structure until said thermosetting resin has cured.

6. The method for manufacturing a metallic hollow golf club head of claim 5, wherein a countersunk portion is provided on the inner surface of said sole plate and said weight is fitted into said countersunk portion; a through hold is provided that passes through both said weight and said sole plate; and said weight is secured to said sole plate by a rivet inserted into the through hole and then caulked.

7. The method for manufacturing a metallic hollow golf club head of claim 5, wherein said light metal is a metal selected from the group consisting of titanium and titanium alloy.

8. The method for manufacturing a metallic hollow golf club head of claim 5, wherein said thermosetting resin is a resin selected from the group consisting of rubber degenerate epoxy resin and urethane degenerate acrylic resin.

9. The method for manufacturing a metallic hollow golf club head of claim 5, wherein the viscosity of said thermosetting resin is lowered to 2000 cps or less by heating the head structure and reducing the pressure in the hollow portion.

* * * * *